US008130990B2

(12) United States Patent
Reithinger

(10) Patent No.: US 8,130,990 B2
(45) Date of Patent: Mar. 6, 2012

(54) FULLY AUTOMATIC SWITCHING ON/OFF IN HEARING AIDS

(75) Inventor: Jürgen Reithinger, Neunkirchen am Brand (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 804 days.

(21) Appl. No.: 12/283,677

(22) Filed: Sep. 15, 2008

(65) Prior Publication Data

US 2009/0087005 A1 Apr. 2, 2009

(30) Foreign Application Priority Data

Sep. 28, 2007 (DE) ..... 10 2007 046 437

(51) Int. Cl.
*H04R 25/00* (2006.01)

(52) U.S. Cl. ..... 381/315; 381/56; 381/11; 381/23.1; 381/123

(58) Field of Classification Search ..... 381/315, 381/56, 11, 23.1, 123
See application file for complete search history.

(56) References Cited

U.S. PATENT DOCUMENTS

| | | | | |
|---|---|---|---|---|
| 4,467,145 | A | 8/1984 | Borstel | |
| 2004/0052391 | A1 * | 3/2004 | Bren et al. | 381/331 |
| 2004/0208332 | A1 * | 10/2004 | Baechler | 381/315 |
| 2006/0109994 | A1 | 5/2006 | Husung et al. | |
| 2007/0253584 | A1 * | 11/2007 | Rass | 381/312 |

FOREIGN PATENT DOCUMENTS

| | | | |
|---|---|---|---|
| DE | 3109049 | C2 | 9/1982 |
| DE | 102004056733 | A1 | 6/2006 |

* cited by examiner

*Primary Examiner* — Tu-Tu Ho

(57) ABSTRACT

In a hearing aid system comprising two hearing aids between which wireless signal transmission is provided. The hearing aids are automatically switched on and off. To this end, a field strength or value of an electromagnetic signal received by a hearing aid that is transmitted from the respective other hearing aid may be determined. The determined value is compared with a threshold value, the relevant hearing aid being switched off (sleep mode), as long as the field strength is greater than the threshold value and the hearing aid being switched on as long as the measured field strength is lower than the threshold value.

15 Claims, 1 Drawing Sheet

FULLY AUTOMATIC SWITCHING ON/OFF IN HEARING AIDS

CROSS REFERENCE TO RELATED APPLICATIONS

This application claims priority of German application No. 10 2007 046 437.3 filed Sep. 28, 2007, which is incorporated by reference herein in its entirety.

FIELD OF INVENTION

The invention relates to a hearing aid system comprising a first and a second hearing aid which may be worn respectively in or on an ear of a user, which respectively comprise an input transducer for receiving an input signal and converting into an electrical input signal, a signal processing unit for processing and amplifying the electrical input signal and emitting an electrical output signal, an output transducer for converting the electrical output signal into an output signal which may be perceived by the user as an acoustic signal and means for wireless signal transmission between the hearing aids.

The invention further relates to a method for operating such a hearing aid system.

SUMMARY OF INVENTION

Hearing aids generally have a manually actuatable switch for switching on and off. In some hearing aids, this switch is incorporated in the battery compartment, so that the hearing aid is switched off as soon as the user pivots the battery compartment slightly out of the normal operating position.

As a result of desired miniaturization, in modern hearing aids there is only relatively little space available for attaching operating elements. Switching on and off such a hearing aid, therefore, requires a certain degree of motor control. Moreover, it is not uncommon for a user to forget to switch off his or her hearing aid, after having removed it from the head for storage.

A hearing aid system comprising two hearing aids which may be worn on the head, between which a wireless signal transmission is provided, for example for transmitting control signals, is known from EP 0 941 014 A2.

Acoustic systems and, in particular, hearing aids which automatically switch between different processing programs are known from DE 10 2004 056 733 A1. In this case it is provided that the signal processing device of a relevant acoustic system has a high frequency detector (HFD) for analyzing an input signal, the output signal thereof being able to be used by the signal processing unit for processing one or more input signals. As a result, the presence of an active mobile phone which emits electromagnetic radiation in the high frequency range may be specifically determined. Consequently, it may be switched to telephone mode with a high degree of reliability, depending on the situation.

A hearing aid is disclosed in the publication DE 31 09 049 C2, in which by the detection of a magnetic field the operating switch of the hearing aid may be switched on or off.

It is the object of the present invention to implement automatic switching on and/or off in a hearing aid system comprising two hearing aids which may be worn on the head.

This object is achieved by a hearing aid system and by a method as claimed in the independent claims.

In a hearing aid of a hearing aid system according to the invention, an input signal is received by means of an input transducer and transferred into an electrical input signal. At least one microphone generally serves as an input transducer, which picks up an acoustic input signal and converts said input signal into an electrical input signal. Modern hearing aids frequently comprise a microphone system comprising a plurality of microphones, in order to achieve a reception which is dependent on the direction of incidence of acoustic signals, a directional characteristic. However, telephone coils or antennae are also common as input transducers for the reception of wirelessly transmitted input signals and conversion into electrical input signals. The input signals converted by the input transducer into electrical input signals are fed to a signal processing unit for further processing and amplification. The further processing and amplification takes place to compensate for the individual hearing loss of a user, generally depending on the signal frequency of the input signal. The signal processing unit delivers at its output an electrical output signal, which is fed via an output transducer to the ear of the hearing aid wearer, so that said hearing aid wearer perceives the output signal as an acoustic signal. Earpieces which generate an acoustic output signal are conventionally used as output transducers. However, output transducers are also known for generating mechanical oscillations, which directly excite specific parts of the ear into oscillation, such as for example the small bones in the ear. Moreover, output transducers are known which directly stimulate nerve cells of the ear. Moreover, operating elements (on/off switches, program switches, volume adjusters etc.) may also be present.

Moreover, a hearing aid of a hearing aid system according to the invention comprises means for wireless signal transmission between the hearing aids, for example implemented by a signal transmission and control unit in combination with a transmitting and receiving coil, which are respectively present in both hearing aids.

For the power supply, hearing aids comprise a battery or a rechargeable battery. In order to increase the life of the power source, consideration is given to low energy consumption of all components of the device.

Therefore, the transmit power in a hearing aid system which provides wireless signal transmission between the hearing aid devices, is adjusted such that precisely the distance between the two ears of a user may be bridged thereby.

The invention provides, at least in one of the two hearing aids, to determine the field strength of a received signal transmitted by the other hearing aid, from which an indication about the current distance between the two hearing aids relative to one another may be obtained. If both hearing aids are worn at the same time on the head, therefore, the field strength is adjusted such that reliable data transmission between the hearing aids is just possible. If the hearing aids, however, are located in the vicinity of one another in a storage box, the field strength measured in the hearing aid is many times higher. From the measured field strength, a hearing aid may therefore derive information about whether it is worn on the head or whether it is located in the storage box.

For the method according to the invention, a relatively approximate determination of the field strength is sufficient. The field strength measurement may, for example, be carried out by using a simple useful signal level measuring device, which is incorporated in one of the receiving filter stages or receiving amplifier stages of the signal transmission unit and detects a voltage value.

Advantageously, the measured field strength is compared with a threshold value. If the field strength is below the threshold value, this is an indication that the two hearing aids are worn on the head. If the measured field strength, however, exceeds the threshold value, this is an indication that the hearing aids are not worn on the head, but are located in the close vicinity of one another for storage, for example in a storage box.

As soon as the measured field strength exceeds the threshold value, the relevant hearing aid is automatically switched off, for example by means of a suitable software control. In the switched-off state, essential power consumers of the hearing aid, such as for example the input transducer, the output transducer as well as the signal processing processor, are disconnected from the power supply. The hearing aid according to the invention, however, is not completely disconnected from the power source, so that at least components for the wireless signal transmission between the hearing aids are still active. Nevertheless, the power consumption is reduced in this switched-off state (sleep mode) in comparison with the fully switched-on hearing aid. In sleep mode, the relevant hearing aid recognizes when the measured field strength falls below the threshold value, whereby the hearing aid automatically switches itself on again.

The invention provides the advantage that, in a simple manner, the relevant hearing aid is therefore automatically switched on and off. Thus also a manually actuatable operating element for switching on and off may be entirely dispensed with. This is in particular also advantageous for the manufacture of a waterproof hearing aid.

Advantageously, both hearing aids of the hearing aid system according to the invention have a corresponding field strength measuring device. However, it is also possible that only one of the two hearing aids has a field strength measuring device and a control signal is transmitted from this hearing aid to the other hearing aid, which then causes the second hearing aid to be automatically switched on or off.

Naturally, it is possible within the scope of the invention not to measure directly the field strength, at which a signal transmitted by the second hearing aid of a hearing aid system according to the invention is applied to the first hearing aid, but also any other variable dependent on this field strength. For example, the signal level of the signal received by the first hearing aid may be determined.

BRIEF DESCRIPTION OF THE DRAWINGS

The invention is described in more detail hereinafter with reference to an embodiment, in which.

DETAILED DESCRIPTION OF INVENTION

Figure 1:
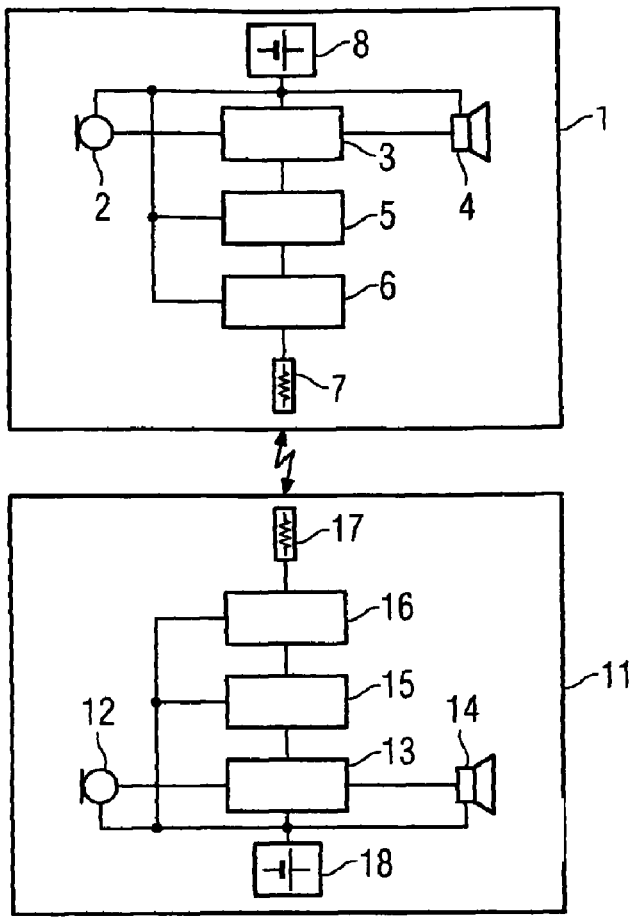
FIG. 1 shows a hearing aid system comprising two hearing aids which may be worn on the head of a user according to the invention in a block diagram and FIG. 2 shows a flow chart for the automatic switching on and off of a corresponding hearing aid.

FIG. 1 shows a hearing aid system comprising a first hearing aid 1 which may be worn on the head of a user and a second hearing aid 11 which may be worn on the head of a user. The hearing aids 1 and 11 respectively comprise a microphone 2 and/or 12 for receiving an acoustic input signal and converting into an electrical input signal. A signal processing unit 3 and/or 13 serves for the processing and frequency-dependent amplification of the electrical input signal. The electrical output signal generated by the signal processing unit 3 and/or 13 is converted by an earpiece 4 and/or 14 into an acoustic output signal and fed to the ear of a user. The signal processing in the signal processing units 3 and/or 13 may be adapted by the adjustment of a plurality of parameters to different hearing environments. For example, the hearing programs and/or operating modes "speech in low background noise", "speech in interfering noise", "telephoning", etc. are available. The adjustment of the parameters of the individual hearing programs as well as the settings for individually compensating for the hearing loss of a user take place by means of the signal transmission and control units 5 and/or 15, to which the transmitting and receiving coils 7 and/or 17 are connected for wireless data transmission, in combination with an external programming device (not shown).

Moreover, in the hearing aids 1 and 11 the one respective field strength measuring device 6 and/or 16 is present, by means of which the field strength of an electromagnetic signal received by the transmitting and receiving coil 7 and/or 17 and emitted by the transmitting and receiving coil of the respective other hearing aid may be measured. For the decision whether the two hearing aids are currently worn on the head or are stored in the vicinity of one another, a relatively approximate determination of the field strength is sufficient. Preferably, for the field strength measurement a level meter is incorporated in one of the receiving filter stages or receiving amplifier stages arranged downstream of the transmitting and receiving coil 7 and/or 17. Advantageously, the measured signal levels are compared in the signal transmission and control units 5 and/or 15 with a specific threshold value. If the measured field strength exceeds the threshold value, this is an indication that the two hearing aids 1 and/ 11 are at a very short distance from one another. The hearing aids 1 and 11 are therefore, controlled by the signal transmission and control units 5 and/or 15, switched into sleep mode and remain in this state until the measured field strengths fall below the threshold value again. In sleep mode the hearing aid is switched off, i.e. essential components of the hearing aid such as the microphones 2 and/or 12, the signal processing units 3 and/or 13 and the earpieces 4 and/or 14 are disconnected from the power source 8 and/or 18. Only the components required for wireless signal transmission, namely the transmitting and receiving coils 7 and/or 17, the field strength measuring devices 6 and/or 16 as well as the signal transmission and control units 5 and/or 15 are still in operation and thus connected to the power sources 8 and/or 18. In order to reduce power consumption further, in sleep mode the signal transmission does not take place continuously between the hearing aids but only at specific times, for example in the form of short pulses, which are periodically repeated in the range of seconds. So that this signal transmission, which is carried out only at specific times, functions, a synchronization of the hearing aids 1 and/or 11 is required. Advantageously, both hearing aids 1 and 11 are quartz-controlled, so that a relatively good synchronization of the two hearing aids 1 and 11 is provided in any case. Also, the signals transmitted between the hearing aids may be used for synchronization and, in particular, for fine adjustment during synchronization.

The invention provides the advantage that in the hearing aids 1 and 11, which are provided for wireless signal transmission, an automatic switching on and off of the hearing aids is implemented at relatively low additional cost. Also corresponding operating elements for manually switching the hearing aids on and off may therefore be dispensed with. This permits further miniaturization of the devices and increases the operating comfort. Moreover the absence of the operating elements means that production of a waterproof hearing aid is facilitated.

Figure 2:
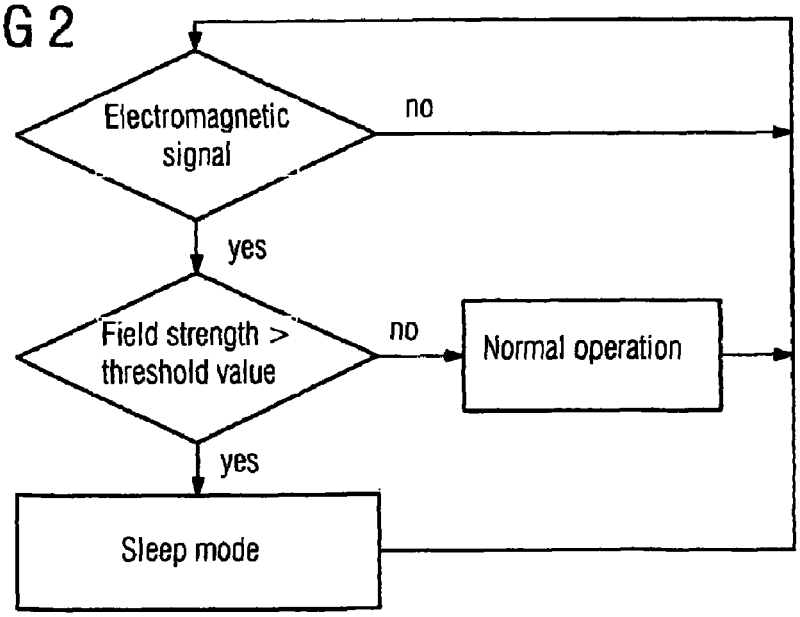

FIG. 2 shows by way of example a flow chart for the automatic switching on and off of a hearing aid according to the invention. To this end, continuously or at specific times, an electromagnetic signal emitted by the other hearing aid of the relevant hearing aid system is received by the hearing aid, a synchronization of the two hearing aids also advantageously taking place using the received signal. Subsequently, the field strength of the electromagnetic signal received by the hearing aid is determined and compared with a threshold value. If the measured field strength is lower than the threshold value, the hearing aid is in normal operation and thus in the switched-on state. If the measured field strength exceeds the threshold value however, the hearing aid is in sleep mode, i.e. in the switched-off state, in which at least essentially only the components required for the wireless signal transmission are operated. This state is maintained until the measured field strength of the received electromagnetic signal falls below the threshold value again.

The invention claimed is:

1. A hearing aid system, comprising:

a first and a second hearing aid, each comprising:

an input transducer for receiving an input signal and converting into an electrical input signal, a signal processing unit for processing and amplifying the electrical input signal and emitting an electrical output signal, an output transducer for converting the electrical output signal into an output signal perceivable by a user as an acoustic signal, and a wireless signal transmission between the hearing aids, wherein a signal transmitted wirelessly from the second hearing aid to the first hearing aid is received in the first hearing aid, wherein the first hearing aid automatically switches the respective hearing aid on or off based on a field strength of the received signal, wherein for the automatic switching the respective hearing aid on or off, the field strength or a variable dependent on the field strength is at least approximately determined by the first hearing aid, and wherein the determined field strength or the determined variable dependent is compared with a first threshold value, and wherein the first hearing aid is automatically switched on or off when the determined field strength or the determined variable dependent exceeds the first threshold value.

2. The hearing aid system as claimed in claim 1, wherein a control signal transmitted from the first hearing aid to the second hearing aid automatically switches the second hearing aid on or off.

3. The hearing aid system as claimed 1, wherein the first hearing aid comprises a level measuring device for determining the signal level of the signal received in the first hearing aid or a signal arising therefrom.

4. The hearing aid system as claimed in claim 3, wherein the level measuring device is incorporated in a receiving filter stage or receiving amplifier stage of the first hearing aid.

5. The hearing aid system as claimed in claim 1, wherein the first and second hearing aids each exclude a manually actuatable on or off switch for the switching on or off of the respective hearing aid.

6. A hearing aid system, comprising:

a first and a second hearing aid, each comprising:

an input transducer for receiving an input signal and converting into an electrical input signal, a signal processing unit for processing and amplifying the electrical input signal and emitting an electrical output signal, an output transducer for converting the electrical output signal into an output signal perceivable by a user as an acoustic signal, and a wireless signal transmission between the hearing aids, wherein a signal transmitted wirelessly from the second hearing aid to the first hearing aid is received in the first hearing aid, wherein the first hearing aid automatically switches the respective hearing aid on or off based on a field strength of the received signal, wherein for the automatic switching the respective hearing aid on or off, the field strength or a variable dependent on the field strength is at least approximately determined by the first hearing aid, and wherein the determined field strength or the determined variable dependent is compared with a second threshold value, and wherein the first hearing aid is automatically switched on or off when the determined field strength or the determined variable dependent is below the second threshold value.

7. A hearing aid system, comprising:

a first and a second hearing aid, each comprising:

an input transducer for receiving an input signal and converting into an electrical input signal, a signal processing unit for processing and amplifying the electrical input signal and emitting an electrical output signal, an output transducer for converting the electrical output signal into an output signal perceivable by a user as an acoustic signal, and a wireless signal transmission between the hearing aids, wherein a signal transmitted wirelessly from the second hearing aid to the first hearing aid is received in the first hearing aid, wherein the first hearing aid automatically switches the respective hearing aid on or off based on a field strength of the received signal, wherein the first and second hearing aids are synchronized, wherein the hearing aids are in a sleep mode while the hearing aids are switched off, wherein a signal is transmitted from the second hearing aid to the first hearing aid during the sleep mode of the hearing aids, and wherein a field strength of the signal received during sleep mode or a variable dependent on the field strength of the signal received during the sleep mode is at least approximately determined by the first hearing aid.

8. The hearing aid system as claimed in claim 7, wherein the second hearing aid only transmits a signal to the first hearing aid within a specific time interval during the sleep mode, and wherein the first hearing aid is switched into a receiving mode only within the time interval in order to receive the signal transmitted by the second hearing aid.

9. A method for operating a hearing aid system, comprising:

providing a first and a second hearing aid, each comprising:

an input transducer for receiving an input signal and converting into an electrical input signal, a signal processing unit for processing and amplifying the electrical input signal and emitting an electrical output signal, an output transducer for converting the electrical output signal into an output signal perceivable by a user as an acoustic signal, and a wireless signal transmission between the hearing aids;

wirelessly transmitting a signal from the second hearing aid to the first hearing aid;

receiving the transmitted signal by the first hearing aid;

automatically switching the first hearing aid on or off based on the received signal;

wherein the automatic switching on or off comprises the first hearing aid at least approximately determining the field strength of the received signal received or determining a variable dependent on the received signal, wherein the automatic switching on or off comprises comparing the determined field strength or the determined dependent variable with a threshold value, and wherein the first hearing aid is switched off when the determined field strength or the determined variable exceeds the threshold value.

10. The method as claimed in claim 9, wherein the automatic switching on or off comprises comparing the determined field strength or the determined dependent variable with a threshold value, wherein the first hearing aid is switched on when the determined field strength or the determined variable is below the threshold value.

11. The method as claimed in claim 9, further comprising:

generating a control signal in the first hearing aid;

sending the control signal to the second hearing aid;

receiving the control signal by the second hearing aid; and automatic switching the second hearing on or off of aid in response to the received control signal.

12. The method as claimed in claim 9, wherein the hearing aids are synchronized by the signal transmitted from the second hearing aid to the first hearing aid.

13. The method as claimed in claim 9, further comprising:

transmitting a further signal from the second hearing aid to the first hearing aid while the hearing aids are switched off;

receiving the transmitted further signal by the first hearing aid; and determining, in the first hearing aid, a field strength of the received further signal or a variable dependent on the received further signal.

14. The method as claimed in claim 13, wherein the further signal is transmitted from the second hearing aid only within a specific time interval, and wherein the first hearing aid switches into receiving mode only within the time interval in order to receive the signal transmitted by the second hearing aid.

15. The method as claimed in claim 13, wherein the first hearing aid is switched into receiving mode only within specific time intervals to receive the further signal transmitted by the second hearing aid.

* * * * *